US007946061B2

(12) United States Patent
Holzer et al.

(10) Patent No.: US 7,946,061 B2
(45) Date of Patent: May 24, 2011

(54) SPORTS SHOE, IN PARTICULAR A SKI SHOE, WITH CLAMPING MEANS THEREFOR

(75) Inventors: Helmut Holzer, St. Johann (AT); Gerhard Trinkaus, Köflach (AT); Jason Roe, Wagrain (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 1023 days.

(21) Appl. No.: 11/810,119

(22) Filed: Jun. 4, 2007

(65) Prior Publication Data

US 2007/0294921 A1 Dec. 27, 2007

(30) Foreign Application Priority Data

Jun. 7, 2006 (AT) ..... A 975/2006

(51) Int. Cl.
*A43B 5/00* (2006.01)

(52) U.S. Cl. ..... 36/50.5; 36/50.1; 36/117.1; 36/51

(58) Field of Classification Search ..... 36/50.1, 36/50.5, 51, 117.1
See application file for complete search history.

(56) References Cited

U.S. PATENT DOCUMENTS

| | | | | | |
|---|---|---|---|---|---|
| 1,211,127 | A * | 1/1917 | Fox | 36/51 |
| 1,595,630 | A * | 8/1926 | Stockton | 36/50.1 |
| 1,689,000 | A * | 10/1928 | Wagner | 36/50.1 |
| 4,095,354 | A * | 6/1978 | Annovi | 36/50.5 |
| 4,258,482 | A * | 3/1981 | Salomon | 36/118.5 |
| 4,408,924 | A * | 10/1983 | Huebner | 403/23 |
| 4,433,456 | A * | 2/1984 | Baggio | 24/68 SK |
| 4,449,273 | A * | 5/1984 | Baggio | 24/68 SK |
| 5,007,186 | A * | 4/1991 | Bischof et al. | 36/118.9 |
| 5,031,340 | A * | 7/1991 | Hilgarth | 36/117.1 |
| 5,647,104 | A * | 7/1997 | James | 24/68 SK |
| 5,651,197 | A * | 7/1997 | James | 36/50.1 |
| 5,655,272 | A * | 8/1997 | Young | 24/482 |
| 5,718,067 | A | 2/1998 | Ostinet et al. | |
| 5,791,021 | A * | 8/1998 | James | 24/68 SK |
| 5,933,985 | A * | 8/1999 | James | 36/50.1 |
| 6,026,594 | A | 2/2000 | Fougere | |
| 6,073,319 | A * | 6/2000 | Silagy | 24/712.1 |
| 7,793,436 | B2 * | 9/2010 | Sink | 36/50.1 |
| 2005/0204585 | A1 * | 9/2005 | Loveridge et al. | 36/54 |

FOREIGN PATENT DOCUMENTS

| | | |
|---|---|---|
| EP | 1654947 | 5/2006 |
| WO | WO 99/65348 | 12/1999 |

* cited by examiner

*Primary Examiner* — Marie Patterson
(74) *Attorney, Agent, or Firm* — Collard & Roe, P.C.

(57) ABSTRACT

The invention relates to a sport shoe (1) with an outer shell (2) made from injection molded plastic, comprising a front foot shell (4) and a shoe cuff (5) adjoining it. At least partially accommodated in the shell (2) is a relatively soft elastic inner shoe (3). In particular, a ski shoe with at least one strap-shaped clamping means (12) disposed at least in a top end portion of the shoe cuff (5) and extending round the top end portion of the shoe cuff (5) is proposed. This strap-shaped clamping means (12) is of a non-stretch design within its entire longitudinal extension and the strap-shaped clamping means (12) is supported on at least one elastically flexible element (15) in the usage or active state, which is disposed between the shoe cuff (5) and the strap-shaped clamping means (12). Alternatively, the strap-shaped clamping means (12) is provided as a clamping means (12) extending at least partially round the shoe cuff (5) and is secured by at least one of its ends to an elastically flexible element (15) permanently mounted on the shoe.

3 Claims, 6 Drawing Sheets

SPORTS SHOE, IN PARTICULAR A SKI SHOE, WITH CLAMPING MEANS THEREFOR

CROSS REFERENCE TO RELATED APPLICATIONS

Applicants claim priority under 35 U.S.C. §119 of AUSTRIAN Patent Application No. A 975/2006 filed on Jun. 7, 2006.

BACKGROUND OF THE INVENTION

1. Field of the Invention

The invention relates to a sport shoe, comprising an outer shell made from a relatively dimensionally stable plastic, a relatively soft elastic inner shoe at least partially accommodated in it and a clamping means for the top end portion of the shoe cuff.

2. Prior Art

A sport shoe of the generic type, in particular a ski shoe with a clamping means for the shoe cuff extending in a circle is known from patent specification U.S. Pat. No. 6,026,594 A, amongst others. This clamping means for limiting the width or narrowing of the top end portion of the shoe cuff comprises several, in particular three, strap elements aligned adjacent to one another in a row which are or can be joined to one another at their ends in the manner of a chain. The central or middle strap element of the clamping means, which is closed in a ring in the operating mode, is of an elastically stretchable design. The respective strap element adjoining the end portions of the elastic strap element are fixedly connected to one another at their end portions remote from the elastic strap element by means of a buckle-type adjusting means, as a result of which the effective length of the clamping means can be individually adjusted. In the operating mode in which the clamping means is active, a relatively constant pressure is exerted on the shoe cuff directly and on the portion of the inner shoe surrounding the lower leg of the user indirectly due to the elastic strap portion. This means that when a clamping means is activated with the outer, hard shoe cuff disposed in between, a specific forward biasing force is applied to the inner shoe and thus as a result to the lower leg of the user. The purpose of this elastic strap portion is to pre-vent the shoe cuff from becoming loose and gaps forming between the lower leg and the shoe cuff where a plurality of movements inducing loads and movements relieving these loads occur. In particular, this design is intended to maintain the most constant possible pressure between the user's leg and the shoe, even over long periods. Although this known clamping means incorporating an elastic strap portion is able to counteract undesired loosening of the shoe cuff during the period of use of the sport shoe, comfort of the ski shoe during use or when wearing it is not significantly improved.

Patent specification U.S. Pat. No. 5,718,067 A likewise discloses a sport shoe of the generic type, with a clamping means for the top collar portion. This strap-type clamping means extends from the rear portion of the relatively rigid cuff of the sport shoe in a ring as far as the front cuff region of the sport shoe and thus supports the front face of the tongue of the comfort inner shoe inserted in the sport shoe in the actively clamped state, thereby preventing any widening of the inner shoe in its tongue portion. However, this known system is not necessarily satisfactory.

In the case of sport shoes with a relatively soft elastic inner shoe and an intrinsically relatively stiff outer shell body surrounding at least certain regions of the inner shoe, the inner shoe is particularly important in terms of offering a high degree of comfort for the wearer. The outer shell body, on the other hand, is primarily designed to transmit force to a sports device, as is the case with ski shoes, roller skates or ice skates, snowboard shoes and similar, for example. In order to avoid unpleasant pressure points on the user's foot as far as possible, the known inner shoes are provided with thick cushioning and in some cases these inner shoes are adapted as far as possible exactly to the shape of the respective user's foot. These features offer only partially satisfactory results and the individual foaming or adapting processes are complex as well as time-consuming and cost-intensive in particular. Also known are inner shoes which have a plate-type reinforcing element stitched or adhered to the external face. Furthermore, some known inner shoes have partial gaps or recesses for specific parts of the foot, for example for the ankle, in order to prevent unpleasant pressure points on the respective user's foot. In terms of the structure of the inner shoe, these features increase the production costs of the sport shoe and precautions of this nature can not be adapted to the individual requirements and different foot shapes of different users. Furthermore, inner shoes of this type can no longer be modified subsequently.

SUMMARY OF THE INVENTION

The underlying objective of this invention is to propose a soft elastic inner shoe and a relatively hard outer shell, which combine the highest possible wearing comfort with the highest possible performance achievable by the user, in particular as regards the transmission of force to a sports device.

This objective is achieved by means of a sport shoe with an improved clamping means based on the features defined in claim 1. Of particular advantage is the fact that the uppermost cuff portion of a sport shoe of this type, often also referred to as the shoe collar, is able to maintain the respectively desired width and forward bias on the calf portion of the user. In particular, the elastically flexible element is better able to suppress detrimental loosening of the cuff portion, even after intensive changes of load, such as usually occur when the sport shoe is in use. In other words, the initial or original setting of the pre-tensioning of the clamping means remains largely constant, even towards the end of the period during which the sport shoe is used. The elastic element also enables an elastic pre-tensioning force to be applied within a defined spring path, so that certain changes in the circumferential width or shape of the shoe inner cuff are possible within defined limits during use of the sport shoe. When load on the cuff portion is then relieved, a rebounding movement of the lower foot and the shin is then assisted by the force of the elastic element, which surprisingly improves the performance which can be achieved, in particular the way in which force is transmitted to a sports device, for example a ski. In addition to this so-called "rebound", another specific advantage of this construction is the fact that the largely non-stretch, strap-type clamping means are able to withstand high tensile forces and in particular can not be damaged or stretched or excessively stretched in the event of strong pulling on them, for example with two hands, because of the non-stretch and hence tension resistant design. The elasticity needed to produce the pre-tensioning effect of the clamping means is produced by the shoe cuff, amongst other things, but primarily due to the elastically flexible element. In particular, the specified construction results in an especially robust, functionally improved clamping means for narrowing the top end portion of the shoe cuff to the required degree.

As a result of the design, different clamping means can easily be prefabricated for different sport shoes and an optimal co-operation or relative position is always guaranteed between the elastically flexible element and the strap-shaped clamping means.

The embodiment enables an inexpensive but durably robust clamping means to be obtained in the top cuff portion of the sport shoe.

As a result, good bending ability of the elastically flexible element can be obtained transversely to its longitudinal direction, thereby enabling it to be adapted to relatively small and large cuff diameters without difficulty.

The advantage is that the elastically flexible element is unobtrusive and compact and does not obstruct the front opening portion of the shoe cuff, thereby making it easier to step into the sport shoe.

The features are of particular advantage because the elastically flexible element is subjected exclusively to compression loads, which elastically compress the elastically flexible element. In particular, the elastically flexible element is not subjected to any tensile stress at all. This improves both the robustness and the functionality of the elastically flexible element.

As a result, the springing or pre-tensioning effect of the elastic element can easily be visually checked and compared by a user. Furthermore, relatively wide, spring-biased movements with a relatively constant spring force can be achieved.

As a result of the embodiment, an elastic flexibility can be produced both for the left-hand and the right-hand pulling strand of the clamping means.

The embodiment results in a compact mounting of the elastically flexible element on the shoe cuff. An elastically flexible element of this type is also inexpensive and functionally stable.

As a result of the embodiment, a stable mounting on the sport shoe can be obtained which is protected against functional impairment.

The features result in optimized mounting on the sport shoe in terms of space. Alternatively or in combination, the deformation resistance of the elastically flexible element in the direction extending transversely to its longitudinal axis can be used to apply an elastic pre-tensioning to the strap-shaped clamping means.

The embodiment ensures a functionally optimal co-operation between the strap-shaped clamping means and the elastically flexible element.

As a result of the features, the compressibility and elastic rebound behavior of the elastically flexible element can be easily improved and adapted to respective requirements.

An elastically flexible element which is inexpensive to produce and at the same time reliable during use is achieved as a result of the features. In particular, these features avoid any sharp edges on the elastically flexible element.

As a result of the embodiment, overloading of the elastically flexible element is easily avoided because as the pressure acting on the elastically flexible element increases, its force of resistance also increases.

As a result of the advantageous embodiment, a respective pre-tensioning effect is imparted to the two pulling strands of the clamping means, i.e. the pulling element co-operating with the left-hand side and the right-hand side of the shoe cuff, even though only a single central element is provided.

As a result of the features, the elastic element and the shoe cuff co-operate in a fixed manner and the strap-shaped clamping means is also retained on the sport shoe so that it can not work loose.

Due to the features, the volume of the elastically flexible element is reduced and a compact, unobtrusive mounting on the sport shoe can be achieved.

A particularly robust construction which is protected against overloading can be achieved.

Due to the features, relatively constant spring forces can be generated within relatively broad spring paths. A construction of this type also results in unchanged and constant functionality for a long period.

As an alternative to the embodiment, the objective of the invention can also be achieved on the basis of the features, resulting in an improved clamping device.

BRIEF DESCRIPTION OF THE DRAWINGS

The invention will be described in more detail below with reference to examples of embodiments illustrated in the appended drawings. Of these.

DETAILED DESCRIPTION OF PREFERRED EMBODIMENTS

Figure 1:
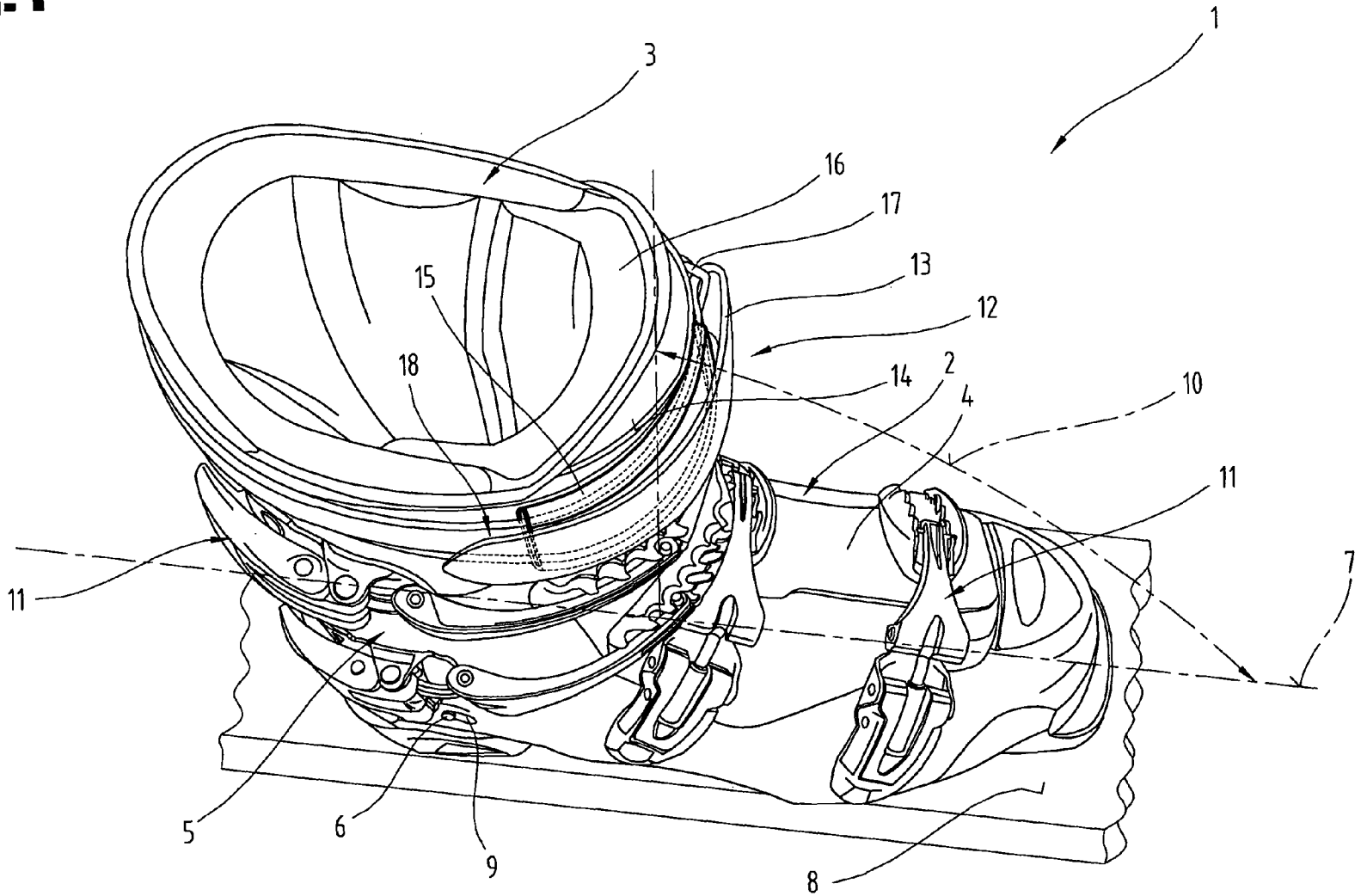
FIG. 1 is a simplified, schematic diagram showing a perspective side view of a generic sport shoe together with a clamping means proposed by the invention for the top cuff portion of the sport shoe.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 shows an example of a sport shoe 1, in particular in the form of a ski shoe. This sport shoe 1 comprises a rigid and relatively dimensionally stiff outer shell 2, preferably made from plastic, which at least partially surrounds a relatively soft elastic and flexible inner shoe 3 inserted in it. The inner shoe 3 is preferably made from foamed plastic and textile materials, thereby affording the user the highest possible comfort when the foot of the user is accommodated in the sport shoe 1, in particular in the inner shoe 3. It may be that the inner shoe 3 is designed so that it can be removed from the shell 2 or changed, or alternatively it may also be permanently joined to the shell 2, in particular bonded or stitched to it.

The outer shell 2, which is preferably manufactured by means of a plastic injection molding process, may also have a plurality of orifices and thus form a frame-type or cage-type retaining structure for the inner shoe 3. The purpose of the outer shell 2 disposed around the inner shoe 3 is to transmit forces as efficiently as possible and as far as possible without delay between the user's foot and the respective sports device to which the sport shoe 1 is attached or secured. Instead of the ski shoe illustrated by way of example, the sport shoe 1 may also be a roller skate shoe or ice skate shoe, a snowboard shoe or similar. In particular, a sport shoe 1 of the generic type should be construed as meaning any shoe comprising an outer, relatively stiff shell 2 and an at least relatively stiff cuff or shaft portion and a relatively soft and flexible inner shoe 3 inserted in it.

The shell 2 preferably comprises a front foot shell 4 for accommodating the front part of the foot and a shoe cuff 5 adjoining the front foot shell 4, which surrounds and accommodates at least certain portions of a user's lower leg portion. The shoe cuff 5 is preferably a structurally separate element and is connected to the front foot shell 4 by means of at least one articulated joint 6. This articulated connection may naturally also have connecting means which permit a combined coupling in translation and in rotation. Alternatively, it would also be possible for the shell 2 to be made in a single piece, in which case a deformation zone is provided in the shell 2 disposed in the instep or arch region between the foot and the lower leg in order to permit changes in angle between the front foot shell 4 and the shoe cuff 5.

The articulated joint 6 or the transition portion between the front foot shell 4 and the shoe cuff 5 defines a pivot axis extending essentially transversely to the longitudinal axis 7 of the shoe sole and essentially parallel with the standing plane 8 for the inner shoe 3. In order to set, limit and/or damp a movement between the front foot shell 4 and the shoe cuff 5 individually, a setting and/or damping device 9 based on one of the designs known from the prior art may be provided on the sport shoe 1. As a result of this setting and/or damping device 9, an angle of inclination 10 between the front foot shell 4 and the shoe cuff 5 can be set and this setting and/or damping device 9 counteracts a change in the angle of inclination 10 due to different angles between the user's shin and the front foot by means of a defined, optionally individually adjustable resistance. In particular, this setting and/or damping device 9 enables a so-called forward damping or forward restriction of the shoe cuff 5 relative to the front foot shell 4. The setting and/or damping device 9 is preferably disposed in the rear portion of the shoe cuff 5 co-operating with the calf.

The front foot shell 4 and/or the shoe cuff 5 is provided with at least one strap means 11 in order to vary the volume which can be accommodated by the surrounding front foot shell 4 and the shoe cuff 5, in particular to make it smaller and larger as necessary. In particular, an appropriate pre-tensioning is applied to the inner shoe 3 by means of this at least one strap means 11, thereby enabling the foot to be retained in the sport shoe 1 as far as possible without any clearance. This strap means 11 may incorporate any elements known from the prior art, such as lever clasps, catch elements, hooks for winding clamping cables on and similar. The strap means 11 for securing or tightening the inner shoe 3 and retaining the foot may also be provided in the form of pressure plate arrangements or similar which can be displaced as required. The essential aspect is that by means of the at least one strap means 11, the foot can be retained in the sport shoe 1 as securely as possible and as far as possible without any clearance when the at least one strap means 11 is activated. In addition, stepping into and out of the sport shoe 1 should be as comfortable as possible when the at least one strap means 11 is deactivated.

A sport shoe 1 based on a ski shoe design therefore has a strap means 11 on the shoe cuff 5, but preferably has two strap means 11, in the form of lever-operated clamping clasps to enable the opening width of the shoe cuff 5 to be individually made smaller and made larger as necessary.

The generic sport shoe 1, which comprises a relatively hard and dimensionally stable outer shell 2 and a relatively soft inner shoe 3, has a clamping means 12 which is strap-shaped or extends in a circle in the top end portion of the shoe cuff 5, in particular in the region of the stepping-in orifice for the foot. Amongst other things, the purpose of this clamping means 12 is to make the opening width narrower or limit it, in particular to make the width narrower or limit the top end portion of the shoe cuff 5. This top end portion of the shoe cuff 5 surrounds the stepping-in orifice of the sport shoe 1 in a known manner and encloses the user's leg in the region of the calf.

In the description given below, the expression shoe cuff 5 should also be construed as meaning the top portion of the inner shoe 3 surrounded by at least certain regions of the outer shoe cuff 5.

The clamping means 12, at least certain portions of which are preferably of a strap-shaped design, is provided with at least one adjusting means 13, by means of which the effective active length, i.e. the looping width or pre-tensioning of the clamping means 12 relative to the shoe cuff 5 can be adjusted and adapted to suit the individual wishes of the user. This adjusting means 13 may be of any type known from the prior art and used to change the length and/or orientation and/or pulling direction and/or position of the clamping means 12. The only essential factor is that when this adjusting means 13 is operated, the pre-tensioning of the clamping means 12 on the inner shoe 3 and on the shoe cuff 5 can be varied as desired. By means of this adjusting means 13, therefore, the leg of a user can be secured either relatively more loosely or as far as possible without any gap relative to the shoe cuff 5 and the clamping means 12 can be activated, i.e. tensioned, and deactivated, i.e. loosened via the adjusting means 13. Above all, to make it as easy as possible to step out of the sport shoe 1 and step into the sport shoe 1 with as little effort as possible, the adjusting means 13 is operated accordingly to loosen the clamping means 12. This adjusting means 13 on the clamping means 12 or for the clamping means 12 may be provided in the form of a fastener with burrs, a ratchet buckle, a clamping lever or any other coupling and clamping mechanisms known from the prior art which can be manually activated and deactivated.

The inner shoe 3 of the generic sport shoe 1 projects in at least certain portions beyond a top boundary edge 14 of the shoe cuff 5. In particular, the top end portion of the soft or cushioned inner shoe 3 extends beyond the cuff-type or hollow cylindrical top end portion of the relatively dimensionally stable shoe cuff 5 made from hard plastic. The top end portion, in particular the so-called collar of the inner shoe 3, has relatively thick cushioned or foamed zones, similar to the part-portions of the inner shoe 3 accommodated in the shell 2 in order to ensure that a user's foot is embedded comfortably and as far as possible without pressure points. Above all, this relatively thick cushioning in the top collar portion of the inner shoe 3 should prevent any frequently occurring unpleasant pressure points on the lower leg, in particular on the shin and on the calf of the user, caused by the top boundary edge 14 of the shoe cuff 5 and due to the relatively rigid, top end portion of the shoe cuff 5.

As illustrated by way of example in FIG. 1, the clamping means 12 for the shoe cuff 5 preferably extends in a ring shape around at least part-portions of the circumference of the top end portion of the sport shoe 1. In the active usage state, the clamping means 12 preferably extends in a closed ring around the shoe cuff 5 and the inner shoe 3, as illustrated in FIG. 1. The loop angle of the strap-shaped clamping means 12 relative to the shoe cuff 5 may also be less than 360°, however. In other words, the clamping means 12 may extend around only part-portions of the circumference of the shoe cuff 5.

The functionally improved clamping means 12 illustrated in FIG. 1 is supported on at least one elastically flexible element 15 in the operating state or in the actively clamped state, which is disposed between the shoe cuff 5 and the strap-shaped clamping means 12. This elastically flexible element 15 or buffer element constitutes a limited, elastic deformation zone between the shoe cuff 5 and the clamping means 12, which surrounds at least certain portions of the external face of the shoe cuff 5. In particular, because the elastically flexible element 15 is disposed between the essentially non-stretch, strap-shaped clamping means 12 and the shoe cuff 5, the shoe cuff 5 is able to widen or stretch against the resistance force of the elastically flexible element 15 when loads are generated by the user's foot, until finally the opposing forces of the clamping means 12 and the elastically flexible element 15 are so strong that any further widening of the shoe cuff 5 is prevented. The widening resistance of the shoe cuff 5 may therefore rise almost progressively, due to the characteristic of the elastically flexible element 15 disposed in between.

The elastically flexible element 15 or buffer element created as a result preferably comprises a strip-shaped or block-shaped body of foamed plastic, disposed on the internal face of the clamping means 12 facing the shoe cuff 5. Preferably, a strip-shaped or block-shaped body of this type made from foamed plastic is joined to the strap-shaped clamping means 12 by stitched seams. Alternatively or in combination, the elastically flexible element 15 may be sleeve shaped—as schematically illustrated—and may be threaded onto the strap-shaped clamping means 12. The elastically flexible element 15 or buffer element may also be provided with a textile cladding or surround.

In addition to the compensating and springing function, the clamping means 12 also assumes a pre-tensioning function in conjunction with the elastically flexible element 15 disposed on its internal face, which enables the clamping means 12 to apply a defined pre-tensioning force to the shoe cuff 5 as continuously as possible. This is especially the case if loads are acting on the strap-shaped clamping means 12 alternating with relief of these loads. In particular, the clamping means 12 does not become loose or does so to only a minimal degree, even after being subjected to numerous loads and being relieved of these loads by the shoe cuff 5.

In the embodiment illustrated as an example in FIG. 1, the strap-shaped clamping means extends in a closed ring around the shoe cuff 5. This being the case, the strap-shaped clamping means 12 may also lie against at least certain regions of the inner shoe 3 and on its tongue 16. The clamping means 12 in this instance is designed as an integral band, which has a deflector element 17, for example an eye, at its first end, by means of which the second end of the strap-shaped clamping means 12 can be turned, to enable the clamping width and the pre-tensioning or diameter of the clamping means 12 to be varied. The end of the clamping means 12 turned round on the deflector element 17 can then be secured at the desired adjustment width or pre-tensioning. To this end, at least one adjusting means 18 is provided on the clamping means 12 or for the clamping means 12, which is preferably provided in the form of a fastener with burrs or by positive connections.

Figure 2:
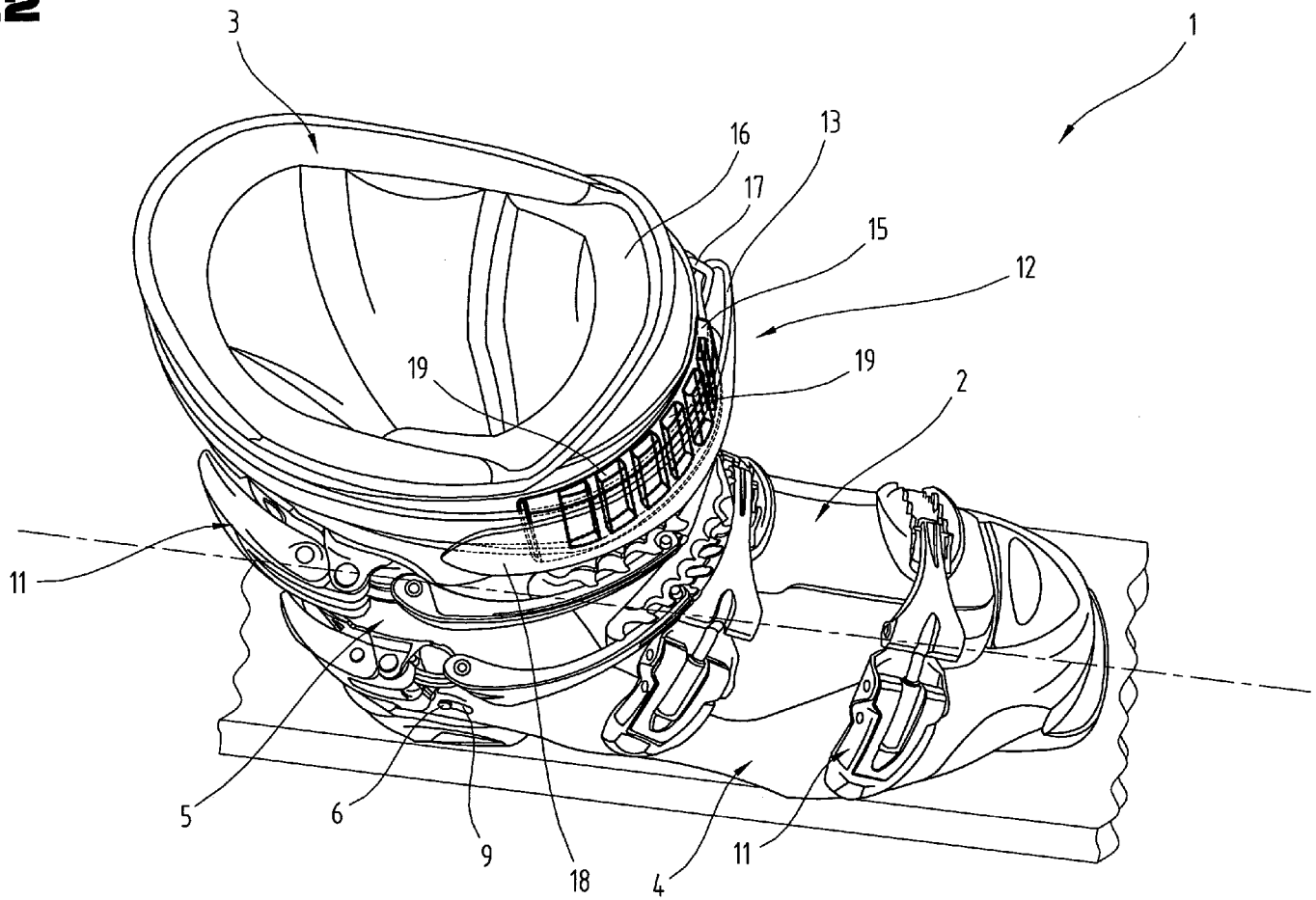
FIG. 2 is a simplified, perspective diagram of the sport shoe illustrated in FIG. 1 with a different embodiment of the clamping means for the top cuff portion of the sport shoe.

FIG. 2 illustrates another embodiment of the clamping means 12 and the elastically flexible element 15. Here too, the elastically flexible element 15 is disposed in the front portion of the shoe cuff 5 by reference to the direction of movement.

In the embodiment illustrated as an example here, the elastically flexible element 15 has a plurality of three-dimensional, for example cuboid, protuberances 19, which serve as elastically flexible thrust bearing elements for the non-stretch clamping means 12. These protuberance 19, which are preferably spaced apart from one another in the longitudinal direction of the clamping means 12, lie either on the internal face of the clamping means 12 or on the external face of the shoe cuff 5, or the elastically flexible protuberances 19 may lie against both the shoe cuff 5 and against the clamping means 12 when the clamping means 12 is in the active state. Alternatively, the protuberances 19 spaced apart from one another in the longitudinal direction of the clamping means 12 may also serve as elastically flexible adjusting means 18 for the pre-tensioning or loop width of the clamping means 12. In this case, the elastically flexible protuberances 19 are additionally used as positive coupling elements for individually adjusting the pre-tensioning or looping width of the clamping means 12.

Instead of providing protuberances 19, another option is to provide recesses or cavities in the elastically flexible element 15, which can form air chambers and produce a specific damping characteristic of the elastically flexible element 15. Such recesses or cavities are easy to produce if using elastically flexible elements made from foamed plastic.

Figure 3:
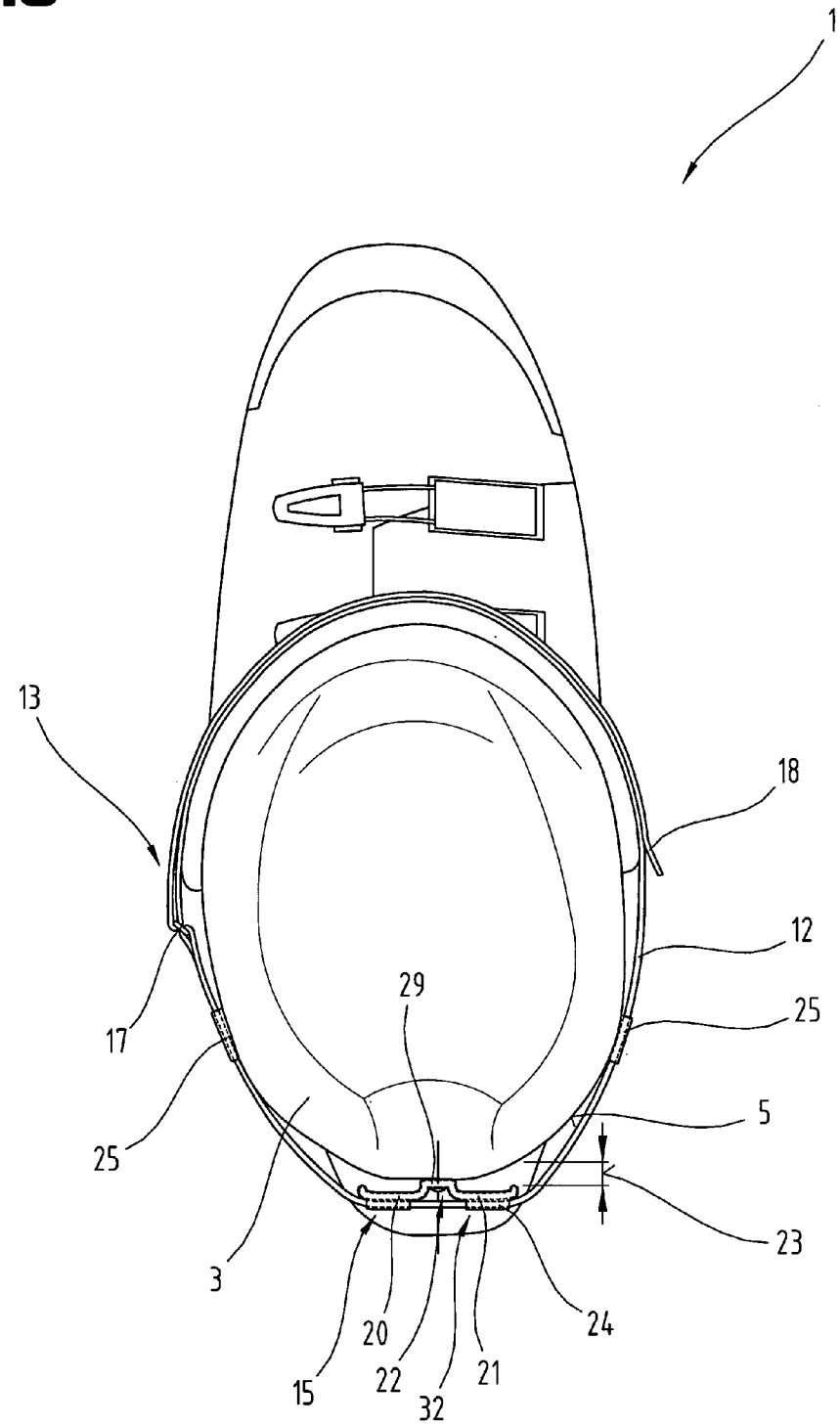
FIG. 3 is a plan view of a sport shoe with a modified design of the clamping means for the top cuff portion.
Figure 4:
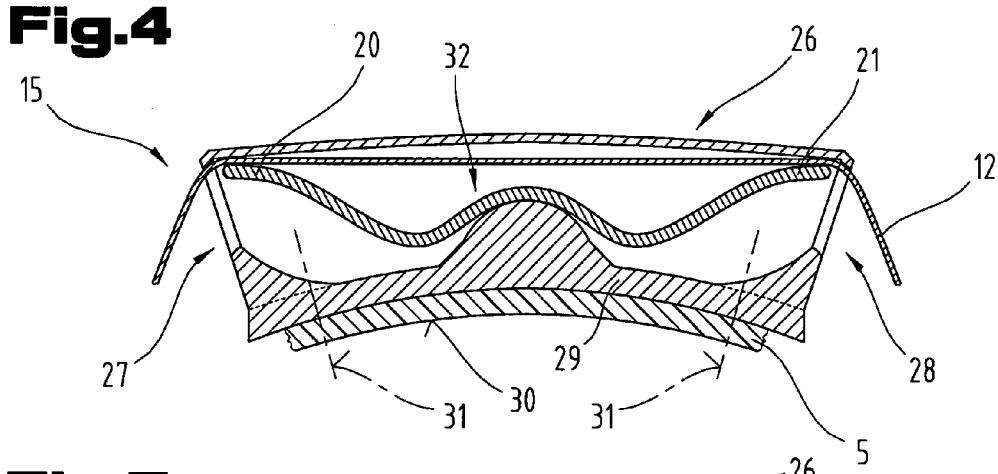
FIG. 4 shows an embodiment of the elastic element for the strap-shaped clamping means.

FIG. 3 illustrates another embodiment of the clamping means 12 and the elastically flexible element 15 co-operating with it, together with the top end portion of a shoe cuff 5. In particular, another variant of a clamping mechanism for the top cuff portion of a sport shoe 1 is illustrated.

In this instance, the elastically flexible element 15 is provided in the rear portion of the shoe cuff. The elastic element 15 is again disposed between the clamping means 12, which is non-stretch as far as possible, and the shoe cuff 5, which is made from hard plastic in particular. The elastically flexible element 15 has at least one elastically deformable resilient arm 20, 21. It is preferable to provide two resilient arms 20, 21 on which the internal face of the strap-shaped clamping means 12 is resiliently supported. The resilient arms 20, 21 extend from a central retaining portion 22 in a wing-type arrangement in the direction parallel with the longitudinal extension of the strap-shaped clamping means 12. The elastic element 15 is joined to the shoe cuff 5 at its central retaining portion 22, in particular is riveted or screwed to it. The remotely facing end portions of the wing-type resilient arms 20, 21, which are preferably provided in pairs, are disposed at a distance 23 from the external face of the shoe cuff 5 when the clamping means 12 is in the non-biased initial state or in the only partially loaded state. This distance 23 represents the maximum available spring path which the elastically flexible element 15 affords for the strap-shaped clamping means 12. In the active state, the clamping means 12 may be pre-tensioned so that a part of the maximum available spring path or distance 23 is used and the rest of the maximum distance 23 is available for a springing action of the clamping means 12. Alternatively, the clamping means 12 may also be pre-tensioned so that the distance 23 is equal to zero when the clamping means 12 is in the clamped state. In this case, the elastically flexible element 15 is always under sufficient initial tension to retain the clamping means 12 in the clamped state and prevent or as far as possible avoid any loosening or slipping of the clamping means 12 when the sport shoe 1 is being used.

This stop limitation for the resilient arms 20, 21 relative to the shoe cuff 5 or relative to the extension of the central retaining portion 20 is also used to avoid excessive loads on the elastically flexible resilient arms 20, 21. Defined stops of this type also offer an easy way of producing a specific limitation to the flexibility of the clamping means 12 and hence a specific limitation to the flexibility of the shoe cuff 5.

The essential point is that the elastically flexible element 15 maintains the pre-tensioning of the clamping means 12 and makes a spring path available which permits an elastic flexibility of the shoe cuff 5 and inner shoe 3.

The elastic element 15 preferably has at least one guide element 24, for example a guide web, in order to hold the clamping means 12 in the correct position relative to the elastic element 15. This is particularly expedient when the clamping means 12 is in the loosened or non-loaded state. The guide element 24 may be provided in the form of an orifice or a loop-type holder on the elastically flexible element 15.

As may also be seen from FIG. 3, at least one retaining element 25 is provided on the circumferential portion of the shoe cuff, by means of which the correct position and planar orientation of the clamping means 12 can also be assured when it is in the loose or loosened state. This retaining element 25 for the strap-shaped clamping means 12 may be provided in the form of an orifice, a hook-shaped projection or a deflection of the clamping means 12 relative to the outside wall of the shoe cuff 5.

FIG. 4 to 7 illustrate other embodiments of elastically flexible elements 15 for strap-shaped clamping means 12. These elastically flexible elements 15 are preferably disposed in or secured to a rear portion of a shoe cuff 5. The strap-shaped clamping means 12 is preferably threaded through the elastically flexible element 15 if it is designed in the manner of a tunnel-type housing 26 and has at least one orifice 27, 28 through which the strap-shaped clamping means 12 is threaded.

The housing 26 or its retaining plate 29 is attached to the external face of the shoe cuff 5. The housing 26 and its retaining plate 29 is preferably arcuately curved. In particular, a mounting surface 30 of the retaining plate 29 has a concave curvature so that it is able to lie with as much of its surface as possible against the external face of the shoe cuff 5 without any gap. In order to mount the housing 26 or the retaining plate 29, positive connections such as screw or rivet connections 31 for example, may be provided. Alternatively, the housing 26 or the retaining plate 29 of the elastic element 15 may also be coupled with the shoe cuff 5 by means of positive coupling mechanisms.

The elastically flexible element 15 in this instance also has at least one resilient element, preferably two resilient arms 20, 21, which form an integral or one-piece resilient element 32, which is retained on the retaining plate 29 and accommodated in the housing 26. In the embodiment illustrated in FIGS. 4 and 5, this resilient element 32 has multiple arcuate curves. The resilient element 32 may be made from spring steel or a resiliently elastic plastic so as to ensure a sufficient springing or damping behavior. The purpose of the multiple curvature of the resilient element 32 is to ensure that for relatively small dimensions of the housing 26 and the element 15 as a whole, a relatively large spring path is provided for the strap-shaped clamping means 12 and a non-linear spring characteristic is provided.

Figure 5:
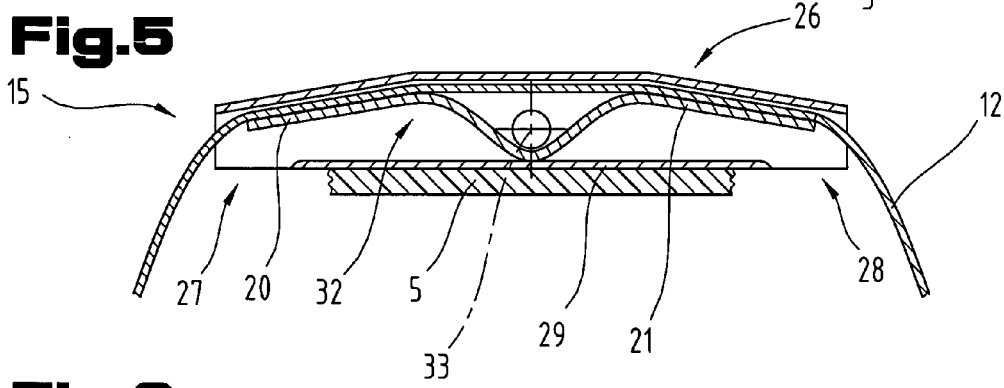
FIG. 5 is a variant of the embodiment illustrated in FIG. 4.
Figure 6:
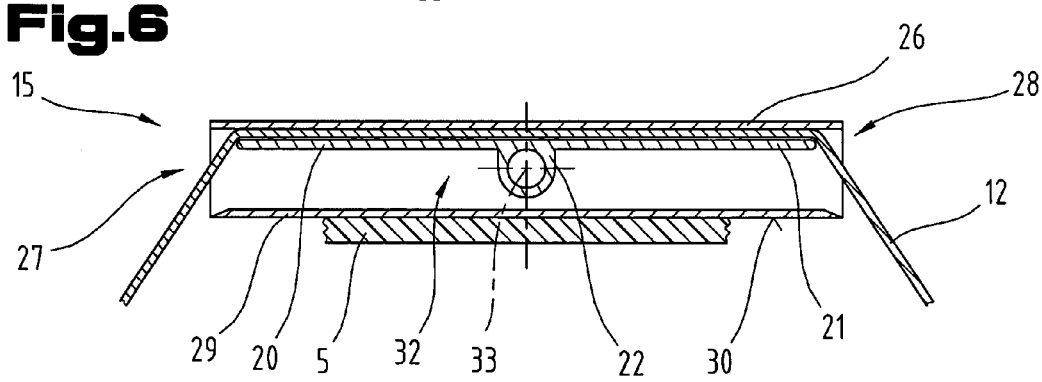
FIG. 6 is another variant of the embodiment illustrated in FIG. 4.

As may be seen from FIGS. 5 and 6, the resilient element 32 may be mounted so that it can rotate inside the elastically flexible element 15. In particular, the resilient element 32 is able to pivot about a pivot axis 33 extending transversely to the longitudinal direction of the clamping means 12 and essentially parallel with its flat face. This enables the elastic element 15 to be more readily adapted to individual requirements. In particular, the pulling action or the pulling direction of the clamping means 12 on the left-hand and right-hand side of the clamping means 12 can be individually varied and better adapted to respective wishes.

FIG. 5 illustrates an embodiment of the elastic element 15 which is optimized in terms of space, whereby the end portions of the housing 26 are tapered.

In the case of the embodiment illustrated in FIG. 6, the resilient element 32 is mounted so as to be pivotable about its central retaining portion 22 about the pivot axis 33. The two resilient arms 20, 21 projecting out from it respectively form collar arms, on which the largely non-stretch clamping means 12 is preferably supported or secured so as to transmit load.

Figure 7:
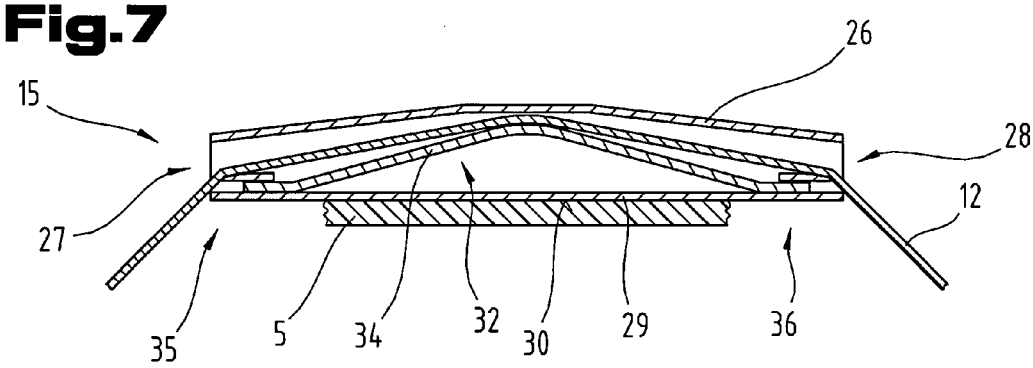
FIG. 7 is a third variant of the embodiment illustrated in FIG. 4.

In the embodiment illustrated in FIG. 7, the elastically flexible element 15 has an arcuately curved leaf spring 34, which fulfils the function of the resilient element 32. Accordingly, the clamping means 12 lies on the central portion of the leaf spring 34, which curves outwards in an arc. The distal ends of this leaf spring 34 are mounted so as to be displaceable in guide mechanisms 35, 36. In particular, these guide mechanisms 35, 36 permit a longitudinal compensation of the leaf spring 34 when it is switched to the almost elongate stretched form due to an elastic deformation. The guide mechanisms 35, 36 for the leaf spring 34 may also be used as a means of positioning the leaf spring 34 and the resilient element 32 inside the housing 26.

Figure 8:
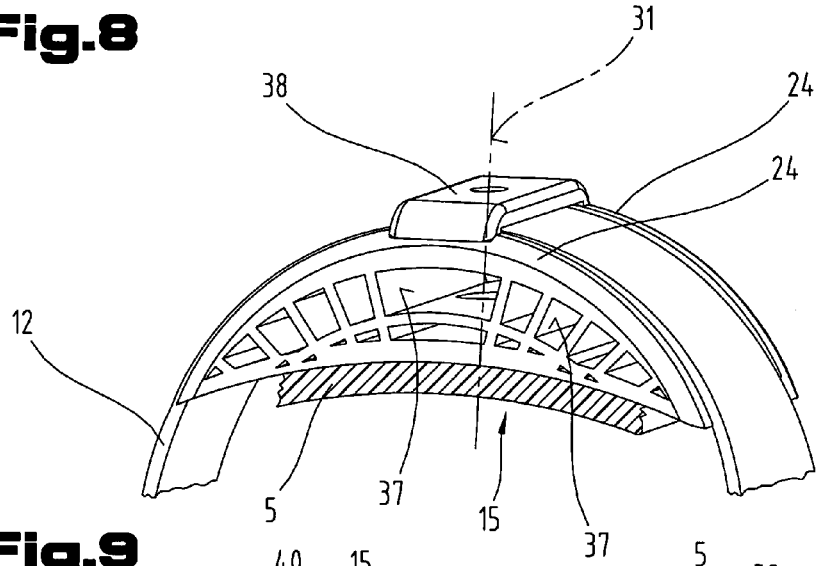
FIG. 8 is a simplified, perspective diagram showing another embodiment of an elastic element together with the strap-shaped clamping means.

FIG. 8 illustrates another example of an embodiment of the elastically flexible element 15 for the essentially non-stretch clamping means 12. In this instance, the elastic element 15 is provided in the form of an injection molded or extruded body. This elastic element 15 is therefore made from an elastomeric plastic, in particular rubber. The intrinsic properties of the rubber material already result in a high elasticity. In addition, good elasticity of this elastic element 15 is achieved due to the ability of the elastic element 15 to change shape in terms of its transverse and longitudinal section. In particular, this elastically flexible element 15 is sickle-shaped or half moon-shaped in longitudinal section. In other words, the biggest body or volume of the elastic element 15 is in its central mounting portion.

In order to further increase its elasticity or compressibility by reference to its cross-sectional shape, the elastic element 15 may be provided with a plurality of orifices 37 or recesses, which extend transversely to the longitudinal extension of the externally lying, strap-shaped clamping means 12. Especially if orifices 37 are provided, they extend transversely to the longitudinal extension and essentially parallel with the flat faces of the strap-shaped clamping means 12.

This elastic element 15 also has at least one guide element 24 for retaining the clamping means 12 in the correct position and ensuring that it is correctly positioned relative to the elastic element 15. The guide element 24 in this instance is provided in the form of two guide webs, which are spaced at a distance apart from one another corresponding to the width of the clamping means 12. In particular, these guide webs form a recess on the external face remote from the shoe cuff 5 for accommodating the strap-shaped clamping means 12.

Due to the effect of an external force, this elastically flexible element 15 is compressed by means of the externally extending clamping means 12. Once the effect of this force is removed, the elastically flexible element 15 rebounds into the initial or non-operating position illustrated in FIG. 8. The elasticity behavior of this elastic element 15 is based on changes in its cross-sectional shape and changes in its shape as regards its longitudinal extension. In particular, this elastic element 15 ensures a sufficiently large spring path for relative movements of the strap-shaped clamping means 12.

This relatively soft elastic element 15 may have at least one mounting plate 38, by means of which the tension and retaining forces of a screw or rivet connection 31 can be distributed across larger portions of the external face of the elastic element 15. This mounting plate 38 may be used as a means of securing the clamping means 12 so that it can not fall off or slide relative to the shoe cuff 5.

Figure 9:
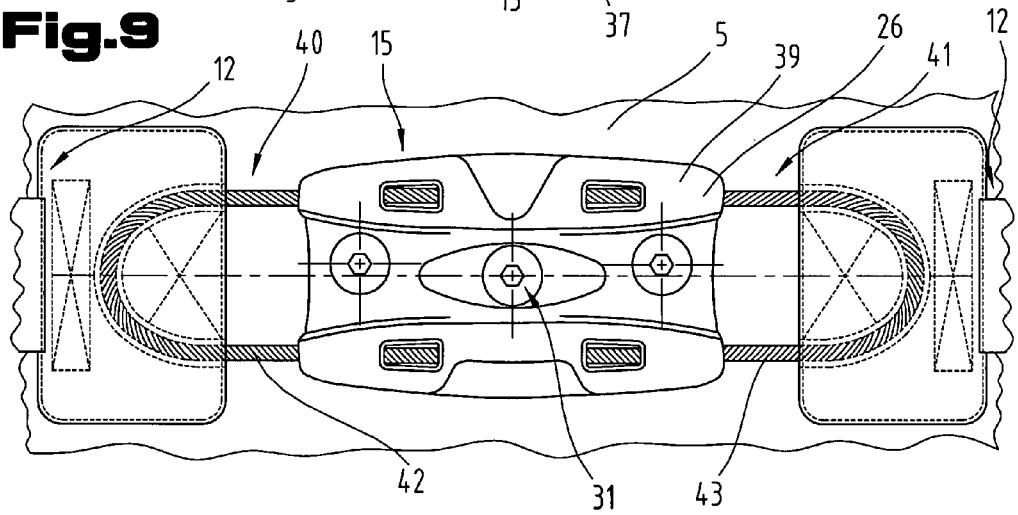
FIG. 9 is a plan view showing an elastic element to be placed under tension.
Figure 10:
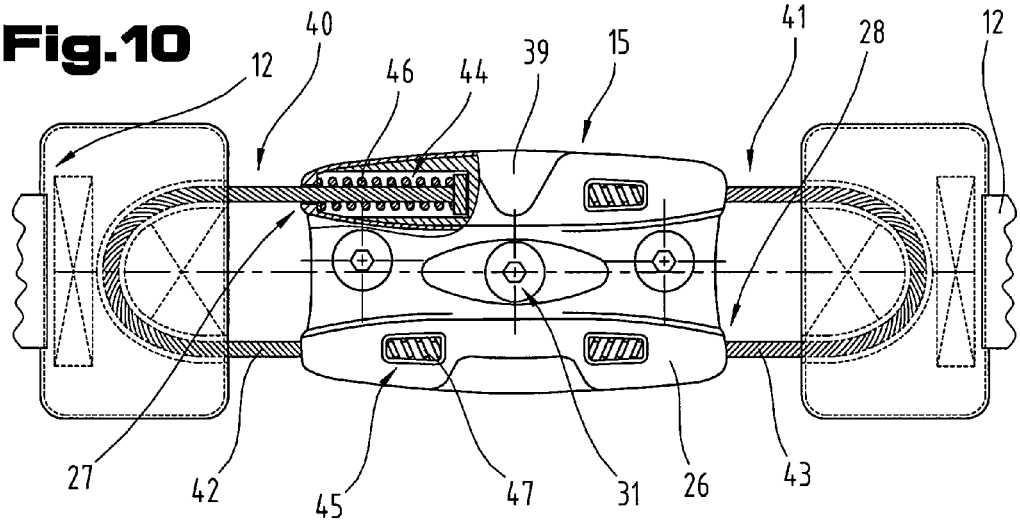
FIG. 10 is another embodiment of the elastic element illustrated in FIG. 9.

FIGS. 9 and 10 illustrate another embodiment of an elastically flexible element 15 for the strap-shaped clamping means 12. In this instance, the strap-shaped clamping means 12 is connected by at least one of its ends to an elastically flexible element 15 permanently fixed to the shoe. The elastic element 15 thus has a rigid retaining plate 39 for providing a fixed connection to the shoe cuff 5. Disposed at oppositely lying ends of this retaining plate 39 is a respective elastically flexible anchoring element 40, 41, on which the two ends of the strap-shaped clamping means 12 are secured. In this instance, the anchoring elements 40, 41 for the clamping means 12 are provided in a loop-type design, in particular by cable loops 42, 43.

In the case of the embodiment illustrated in FIG. 9, the cable loops 42, 43 are elastically stretchable and able to rebound. In particular, the cable loops 42, 43 are cable loops made from an elastomeric material, for example fiber-reinforced rubber. The retaining plate 39 may be connected by means of at least one screw or rivet connection 39 to the shoe cuff 5, in particular to its rear portion, so that it is rigid and unable to move.

In the case of the embodiment illustrated in FIG. 10, the anchoring elements 40, 41 for the clamping means 12 are of a largely non-stretch design but may be resiliently displaced relative to the retaining plate 39 by means of at least one spring means 44, 45, in particular by means of at least one helical spring 46, 47. In particular, two helical springs 46, 47 extend round the end portions of at least one anchoring element 40, 41. These helical springs 46, 47 thus provide an elastically flexible bearing for the anchoring elements 40, 41 relative to the stationary retaining plate 39.

Figure 11:
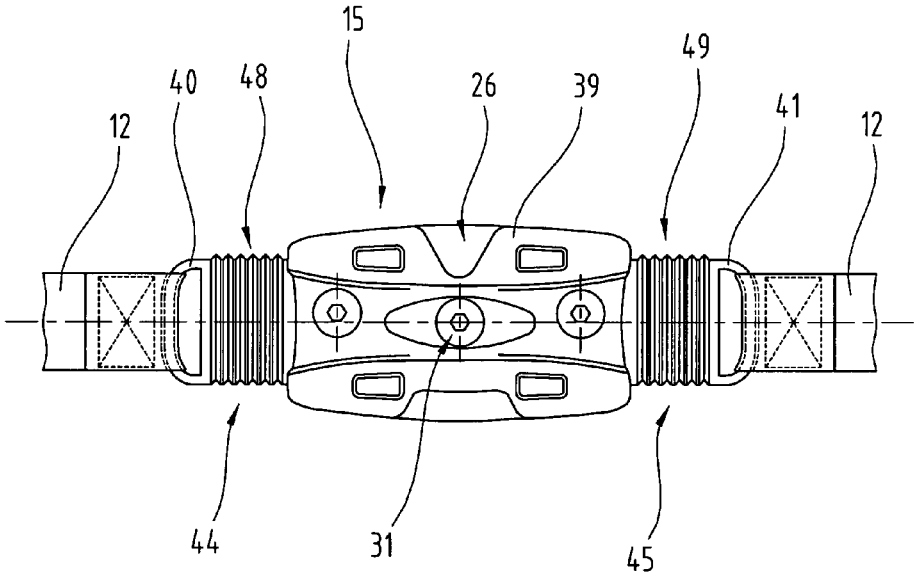
FIG. 11 is another variant of the embodiment illustrated in FIG. 9 or 10.

In the embodiment illustrated in FIG. 11, the anchoring elements 40, 41 for the strap-shaped clamping means 12 are respectively surrounded by an elastically stretchable and automatically rebounding folding bellows 48, 49 or formed by a folding bellows 48, 49 with sufficient elasticity. The ends of the anchoring elements 40,41, which are eye-shaped in this instance, may be used to provide a releasable coupling with or a fixed connection to the strap-shaped clamping means 12 if necessary.

Figure 12:
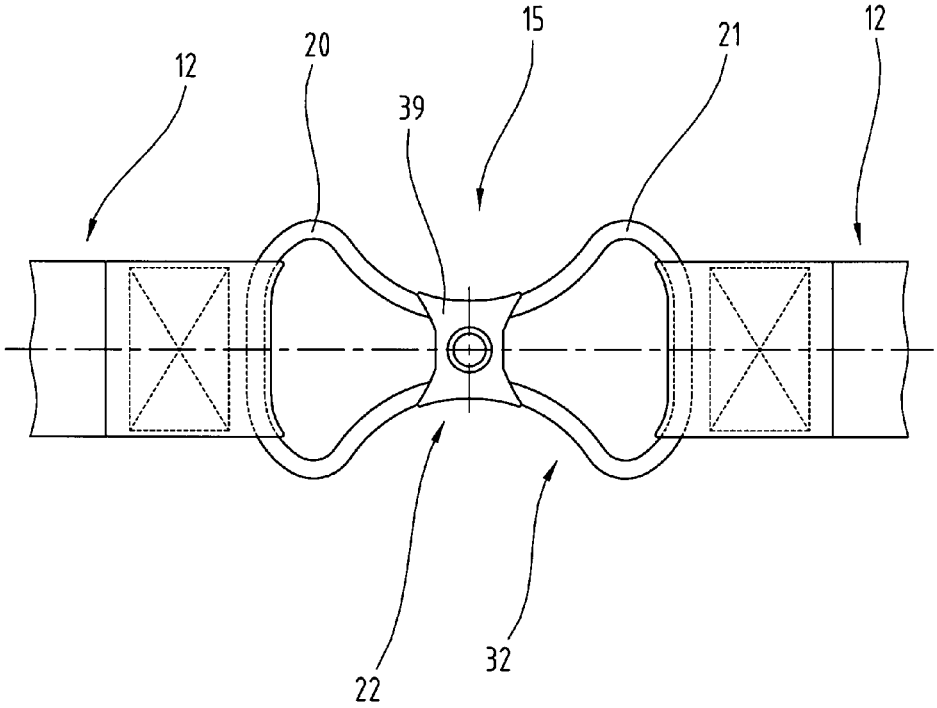
FIG. 12 is a simplified plan view illustrating an example of another embodiment of an elastic element for the strap-shaped clamping means to be placed under tension.

FIG. 12 illustrates another embodiment of the elastically flexible element 15 for the strap-shaped clamping means 12. This elastic element 15 also has holders at its oppositely lying end portions for securing the clamping means 12. The central or middle portion incorporates the retaining plate 39 for securing the elastic element 15 to a shoe cuff. In this instance, the elastic element 15 is of a tapered design in its central retaining portion 22. The elastic element 15 is provided in the form of a spring steel wire, which is looped and has the shape of a figure of eight. When subjected to an appropriate tension via the ends of the clamping means 12, the element 15 preformed in this manner elastically deforms and enables the looping width of the clamping means 12 to be increased.

As an alternative to the embodiment illustrated, the clamping means 12 may comprise at least two parts. Especially if the strap-shaped clamping means 12 does not extend round the entire circumference of the shoe cuff 5, a first end of the strap-shaped clamping means 12 may be rigidly joined to the shoe cuff 5 and the other end of the clamping means 12 may be elastically and flexibly anchored on the shoe cuff 5 via the elastically flexible element 15.

The embodiments illustrated as examples represent possible design variants of the sport shoe 1 and its clamping means 12, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the sport shoe 1 and clamping means 12, they and their constituent parts are illustrated to a certain extent out of scale and/or on an enlarged scale and/or on a reduced scale.

Above all, the individual embodiments of the subject matter illustrated in FIG. 1; 2; 3; 4; 5; 6; 7; 8; 9; 10; 11; 12 constitute independent solutions proposed by the invention in their own right. The objectives and associated solutions proposed by the invention may be found in the detailed descriptions of these drawings.

LIST OF REFERENCE NUMBERS

1 Sport shoe
2 Shell
3 Inner shoe
4 Front foot shell
5 Shoe cuff
6 Articulated joint
7 Longitudinal axis
8 Standing plane
9 Setting and/or damping device
10 Angle of inclination
11 Strap means
12 Clamping means
13 Adjusting means
14 Boundary edge
15 Elastically flexible element
16 Tongue
17 Deflector element
18 Adjusting means
19 Protuberance
20 Resilient arm
21 Resilient arm
22 Retaining portion
23 Distance
24 Guide element
25 Retaining element
26 Housing
27 Orifice
28 Orifice

29 Retaining plate
30 Mounting surface
31 Screw or rivet connection
32 Resilient element
33 Pivot axis
34 Leaf spring
35 Guide mechanism
36 Guide mechanism
37 Orifice
38 Mounting plate
39 Retaining plate
40 Anchoring element
41 Anchoring element
42 Cable loop
43 Cable loop
44 Spring means
45 Spring means
46 Helical spring
47 Helical spring
48 Folding bellows
49 Folding bellows

What is claimed is:

1. A ski shoe comprising:

an outer shell made from injection molded plastic and comprising a front foot shell, for accommodating the front part of the foot, adjoined by a shoe cuff for stabilizing the lower leg portion of a user, a step-in orifice, a relatively soft elastic inner shoe, at least parts of the relatively soft elastic inner shoe being accommodated in the outer shell, at least one clamping strap disposed in a top end portion of the shoe cuff extending partially around the top end portion of the shoe cuff, and at least one adjusting device for narrowing or limiting a width of the step-in orifice, wherein the at least one clamping strap is non-stretchable within an entire longitudinal extension of the at least one clamping strap and the at least one clamping strap is supported on at least one elastically flexible element, wherein the at least one clamping strap extends partially around the shoe cuff when the at least one clamping strip is clamping and is secured to the at least one elastically flexible element by at least one of a first end and a second end of the at least one clamping strap, the at least one elastically flexible element being permanently mounted on the shoe cuff, wherein the first and second ends of the at least one clamping strap extend partially around the shoe cuff and are respectively secured to oppositely lying portions of the elastically flexible element, wherein the elastically flexible element has a central fixing portion for connecting to the shoe cuff, wherein the central fixing portion comprises a rigid retaining plate for providing a permanent connection to the shoe cuff, and wherein the ski shoe further comprises:

a first elastically flexible anchoring element provided at a first end of the rigid retaining plate for the at least one clamping strap; and a second elastically flexible anchoring element provided at a second end of the rigid retaining plate for the at least one clamping strap;

wherein the second end of the retaining plate lies opposite from the first end of the rigid retaining plate.

2. The ski shoe according to claim 1, wherein the elastically flexible element is positioned in the rear portion of the shoe cuff.

3. The ski shoe according to claim 1, wherein the anchoring elements are of a loop-shaped design and are resiliently displaceable relative to the retaining plate.

* * * * *